US011779046B2

(12) United States Patent
Gamberini et al.

(10) Patent No.: US 11,779,046 B2
(45) Date of Patent: Oct. 10, 2023

(54) COMPACTING UNIT AND METHOD FOR THE TOBACCO INDUSTRY

(71) Applicant: G.D S.p.A., Bologna (IT)

(72) Inventors: Giuliano Gamberini, Crevalcore (IT); Marco Esposti, Casalecchio di Reno (IT); Massimo Sartoni, Bologna (IT); Luca Federici, Bologna (IT)

(73) Assignee: G.D S.P.A., Bologna (IT)

( * ) Notice: Subject to any disclaimer, the term of this patent is extended or adjusted under 35 U.S.C. 154(b) by 74 days.

(21) Appl. No.: 16/771,815

(22) PCT Filed: Dec. 10, 2018

(86) PCT No.: PCT/IB2018/059825

§ 371 (c)(1),
(2) Date: Jun. 11, 2020

(87) PCT Pub. No.: WO2019/116196

PCT Pub. Date: Jun. 20, 2019

(65) Prior Publication Data

US 2021/0120865 A1 Apr. 29, 2021

(30) Foreign Application Priority Data

Dec. 13, 2017 (IT) ..... 102017000143643

(51) Int. Cl.
*A24C 5/32* (2006.01)
*A24C 5/47* (2006.01)
*A24D 3/02* (2006.01)

(52) U.S. Cl.
CPC ..... *A24C 5/327* (2013.01); *A24C 5/478* (2013.01); *A24D 3/0241* (2013.01)

(58) Field of Classification Search
CPC ..... A24C 5/478; A24C 5/327; A24C 5/471
See application file for complete search history.

(56) References Cited

U.S. PATENT DOCUMENTS 2,821,201 A 1/1958 Schmalfeldt et al.
3,368,674 A * 2/1968 Koeppe ..... A24C 5/343 209/535
3,715,957 A * 2/1973 Hall ..... A24D 3/0262 493/42

FOREIGN PATENT DOCUMENTS

CN 1882257 A 12/2006
EP 2965639 A1 1/2016
(Continued)

OTHER PUBLICATIONS

International Search Report and Written Opinion dated Mar. 18, 2019 for counterpart International Patent Applicaiton No. PCT/IB2018/059825.

(Continued)

*Primary Examiner* — Kelly M Gambetta
*Assistant Examiner* — Stephanie Lynn Moore
(74) *Attorney, Agent, or Firm* — SHUTTLEWORTH & INGERSOLL, PLC; Timothy Klima

(57) ABSTRACT

A compacting unit for the tobacco industry includes a conveyor drum configured to convey groups of segments disposed perpendicularly to the feed direction. A first compactor and a second compactor have a first contact portion and a second contact portion, respectively. The first contact portion and the second contact portion are respectively adapted to be placed in contact with a first axial end and a second axial end of a group of segments in transit in the compacting station. The first contact portion is compliant, preferably elastically compliant, along a longitudinal direction of extension of the groups of segments upon interaction with the first axial end. The second contact portion defines a rigid abutment along the longitudinal direction of extension of the groups of segments suitable for setting a predetermined position for the second axial end.

12 Claims, 4 Drawing Sheets

(56) References Cited

FOREIGN PATENT DOCUMENTS

| | | | |
|---|---|---|---|
| GB | 902448 | A | 8/1962 |
| WO | 2005046366 | A1 | 5/2005 |
| WO | 2017068479 | A1 | 4/2017 |
| WO | 2017085658 | A1 | 5/2017 |

OTHER PUBLICATIONS

Chinese Office Action dated Sep. 14, 2021 from counterpart Chinese Patent Application No. 201880086123.8.
Indonesian Office Action dated Jan. 12, 2022 from counterpart Indonesian Patent Application No. P00202004392.

* cited by examiner

COMPACTING UNIT AND METHOD FOR THE TOBACCO INDUSTRY

This application is the National Phase of International Application PCT/IB2018/0059825 filed Dec. 10, 2018 which designated the U.S.

This application claims priority to Italian Patent Application No. 102017000143643 filed Dec. 13, 2017, which application is incorporated by reference herein.

TECHNICAL FIELD

This invention relates to a compacting unit and method for the tobacco industry.

More specifically, this invention can be used in the production of a semi-finished product for the tobacco industry, made from two or more rod-shaped segments, generally having different properties and/or functions, and disposed in axial alignment with each other and axially end to end to form a group of segments. After disposing the segments in axial alignment with each other, the group is wrapped in a web of wrapping material or in a connecting strip to make the semi-finished product used to make rod-shaped smoking articles.

BACKGROUND ART

The term "rod-shaped smoking article" is used to denote a plurality of products or smoking articles such as, for example, cigars, cigarillos, cigarettes, including electronic cigarettes, and the like, extending mainly in a longitudinal or axial direction.

According to a first example of application, this invention can be used in a machine and a method for making up composite filters. In effect, it is known that composite filters are obtained by juxtaposing two or more filter segments having different properties—in particular different filtering properties. For this purpose, combining units are known in which individual segments, coming from respective tanks, are transferred in a direction transverse to their longitudinal axis, for example by respective successions of grooved rollers, to a single receiving conveyor provided with peripheral grooves. The segments are placed in each peripheral groove of the conveyor according to a predetermined axial sequence to form a group of segments at the exit of the conveyor. The groups are then transferred, for example by rotary transfer means, to a forming beam along which they advance in a direction parallel to their longitudinal axis and are wrapped in a web of wrapping material to form a continuous filter rod.

The continuous filter rod is then cut into single or double composite filters by a cutting unit located downstream of the forming beam.

According to a second example of application, this invention can be used in a machine known as filter tip attachment machine and in a method for making a semi-finished product, defined by a double cigarette, from cigarette segments and double filters. In prior art filter tip attachment machines, two axially aligned cigarette segments—obtained, for example, by cutting a double cigarette segment transversely in half—are spaced axially apart in such a way that a double filter can be placed between them as they move along in a direction transverse to their longitudinal axis. The set of two cigarette segments with the double filter interposed therebetween defines a group of segments to which a connecting strip of gummed paper is then applied by rolling in order to form the semi-finished product—that is to say, the double cigarette. Once the double cigarettes have been formed, they are made to advance in succession through a cutting station where they are cut in half transversely to obtain two rows of oppositely oriented single cigarettes.

In both of the prior art applications, each group of segments is preferably compacted in an axial direction to eliminate any empty spaces between two adjacent segments. In effect, such empty spaces can negatively affect the quality of the finished product.

Compacting devices are known which are disposed along the transfer path of the groups of segments between the zone where the formation of the group itself is completed and the zone where the formation of the semi-finished product begins. In the case of the machine for making up composite filters, the compacting device may be located downstream of the combining unit—at a transfer drum, for example. In the case of the filter tip attachment machine, the compacting device may be located at a transfer drum upstream of the device which applies the connecting strip and of the rolling device.

Compacting devices are known which comprise two rigid plates disposed at opposite ends of the group of segments in such a way as to compress them slightly in the axial direction. More specifically, the two rigid plates are disposed at a distance from each other which is less than the theoretical length of the group of segments so that if the length of the group on segments is less than the theoretical length, no empty spaces remain between the segments even downstream of the compacting device.

In the case of filter tip attachment machines, such compression can be absorbed by the cigarette segment, which is longer and more compliant than the double filter. In any case, the compression causes deformation of the cigarette segment which may negatively affect the quality of the end product.

In the machines for making up composite filters, however, there might not be a segment capable of absorbing the compression produced by the compacting device. Being unable to absorb the compression, the segments are displaced towards the outside of the groove which contains them, thus creating cusps in the part of the group of segments where the connecting strip will be applied. The Applicant has found that applying the connecting strip over the cusps leads to wrinkling during subsequent rolling.

Document WO2017/068479 describes a device for centring rod-shaped articles and provided with pushers which operate axially on the article in such a way as to modify its position along the groove which contains it. Both of the pushers oscillate and are kept in contact with the article by a spring.

Document WO2017085658 describes a device for centring rod-shaped articles and provided with plates mounted on an arm which is held elastically in contact with the article in transit on a transfer drum.

These centring devices are not capable of guaranteeing the repeatability of the position of the group of segments relative to the subsequent processing stations, reflecting negatively on the quality of the end product.

DISCLOSURE OF THE INVENTION

This invention therefore has for an aim to provide a compacting unit and method for the tobacco industry to overcome the disadvantages described above with reference to the prior art.

More specifically, the aim of this invention is to provide a compacting unit and method capable of eliminating the negative effects of excessive compression on the segments while guaranteeing an end product of high quality.

The invention also has for an aim to provide a compacting unit operating in-line and at high speeds for rod-shaped smoking articles without interfering with the rest of the production line. Lastly, this invention has for an aim to provide a compacting method used for operation at high speeds and thus applicable in the tobacco industry.

The above aims are achieved by a compacting unit and method for the tobacco industry having the features set out in one or more of the appended claims.

In particular, according to a first aspect of it, this invention relates to a compacting unit for the tobacco industry according to the present disclosure and, according to a second aspect of it, to a compacting method applicable in the tobacco industry, according to the present disclosure, for axially compacting groups of rod-shaped segments.

Advantageously, thanks to the presence of a first contact portion that is compliant, preferably elastically compliant, along the axial direction of the groups of segments, it is possible to minimize, or even totally eliminate, the risks of excessively compressing or radially misaligning the segments. Further, the fact that the second contact portion defines a rigid abutment along the axial direction of the groups of segments ensures that each group of segments is correctly positioned in the subsequent processing stations.

In one or more of the aforesaid aspects, this invention may comprise one or more of the features described below.

Preferably, the conveyor comprises at least one rotary member rotating about a feed axis and configured to move the housing grooves along the feed path. Still more preferably, the rotary member is a conveyor drum provided with housing grooves running parallel to the feed axis on an outer mantle of the conveyor drum itself. Alternatively, the rotary member is a return and/or drive element of a belt conveyor: for example, a pulley or a return roller.

Preferably, the first compactor comprises a compacting member on which the first contact portion is mounted or formed. Still more preferably, the compacting member of the first compactor has the shape of a cup with a circumferential edge, where the first contact portion is circumferentially disposed.

Preferably, the first contact portion is inherently compliant. Alternatively or in addition, the first contact portion is mounted compliantly on the compacting member of the first compactor. Preferably, the first contact portion is defined by a leaf spring mounted on the compacting member of the first compactor by connecting means—for example, threaded elements—in such a way as to have a first arm mounted on the compacting member and a second arm which oscillates relative to the first arm as a result of interaction with the first axial end of the first group in transit in the compacting station. Alternatively, the first contact portion is defined by one or more of the following: a pad—for example, made of rubber or other compliant material; a plug which is movable in opposition to an elastic force; a plug which is movable in opposition to a pneumatic or hydraulic force.

Preferably, a sequence of contact surfaces of the first contact portion is brought in succession to the compacting station. For example, the first compactor comprises a compacting member which is movable in such a way as to bring a sequence of contact surfaces of the first contact portion in succession to the compacting station. Still more preferably, the compacting member of the first compactor rotates about a compacting axis and the first contact portion is disposed circumferentially around the compacting axis.

Preferably, the compacting member of the first compactor is disposed around the feed axis of the conveyor. Still more preferably, the compacting axis of the compacting member of the first compactor is inclined to the feed axis of the conveyor so that the respective first contact portion can be positioned in contact with the first axial end of at least one group of segments passing through the compacting station.

Preferably, the first contact portion is disposed at a minimum distance from the conveyor, preferably from the conveyor drum, at the compacting station and at a maximum distance from the conveyor, preferably from the conveyor drum, at a position diametrically opposite to the compacting station.

Preferably, the position of the compacting member of the first compactor is adjustable towards or away from the compacting station as a function of the length of the groups of segments. The position of the first contact portion is therefore adjustable towards and away from the compacting station as a function of the length of the groups of segments. Still more preferably, the first compactor comprises a slide which is slidable in a direction parallel to the feed axis of the conveyor and which supports the compacting member of the first compactor.

Preferably, the compacting member of the first compactor is driven by the conveyor, in particular by the conveyor drum, in such a way as to bring a sequence of contact surfaces of the first contact portion in succession to the compacting station.

Preferably, the second compactor comprises a compacting member on which the second contact portion, preferably the compacting member of the second compactor, is mounted or formed. Still more preferably, the compacting member of the second compactor has the shape of a cup with a circumferential edge, where the second contact portion is circumferentially disposed.

Preferably, a sequence of contact surfaces of the second contact portion is brought in succession to the compacting station. For example, the second compactor comprises a compacting member which is movable in such a way as to bring a sequence of contact surfaces of the second contact portion in succession to the compacting station. Still more preferably, the compacting member of the second compactor rotates about a compacting axis and the second contact portion is disposed circumferentially around the compacting axis.

Preferably, the compacting member of the second compactor is disposed around the feed axis of the conveyor. Still more preferably, the compacting axis of the compacting member of the second compactor is inclined to the feed axis of the conveyor so that the respective second contact portion can be positioned in contact with the second axial end of at least one group of segments passing through the compacting station.

Preferably, the second contact portion is disposed at a minimum distance from the conveyor, preferably from the conveyor drum, at the compacting station and at a maximum distance from the conveyor, preferably from the conveyor drum, at a position diametrically opposite to the compacting station.

Preferably, the position of the compacting member of the second compactor is adjustable towards or away from the compacting station as a function of the length of the groups of segments. The position of the first contact portion is therefore adjustable towards and away from the compacting station as a function of the length of the groups of segments. Still more preferably, the second compactor comprises a slide which is slidable in a direction parallel to the feed axis of the conveyor and which supports the compacting member of the second compactor.

Preferably, the compacting member of the second compactor is driven by the conveyor, in particular by the conveyor drum, in such a way as to bring a sequence of contact surfaces of the second contact portion in succession to the compacting station.

Preferably, the compacting unit comprises two compacting members, forming part of the first and second compactor, respectively, and rotating about respective compacting axes which are inclined at equal and opposite angles to the feed axis of the conveyor, in particular of the conveyor drum.

BRIEF DESCRIPTION OF THE DRAWINGS

The invention is described below with reference to the accompanying drawings, which illustrate a non-limiting embodiment of it and in which.

DETAILED DESCRIPTION OF PREFERRED EMBODIMENTS OF THE INVENTION

Figure 5:
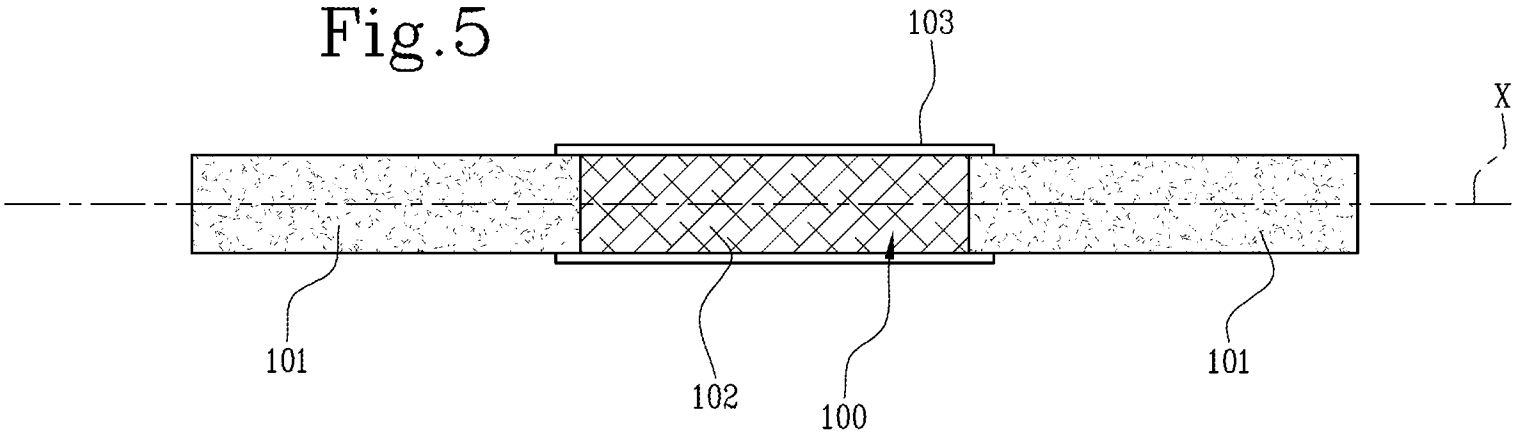
FIG. 5 schematically illustrates a semi-finished product of the tobacco industry, specifically a double cigarette, used to make a rod-shaped smoking article.
Figure 6:
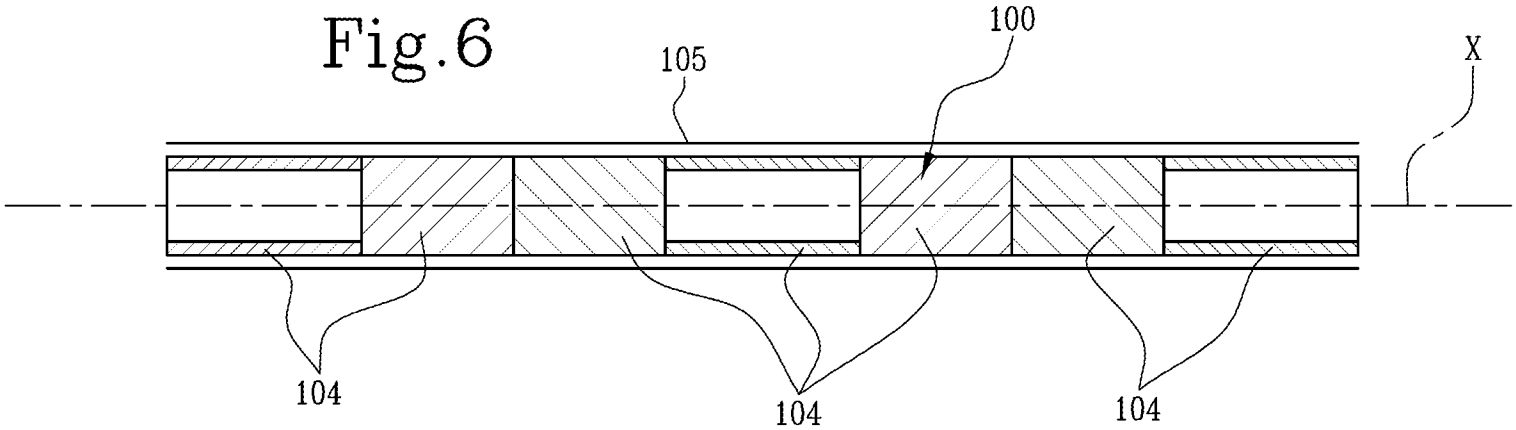
FIG. 6 schematically illustrates a semi-finished product of the tobacco industry, specifically a double composite filter, used to make a rod-shaped smoking article.

With reference to FIGS. 5 and 6, the numeral 100 denotes a group of rod-shaped segments. The group 100 comprises at least two segments disposed in axial alignment with each other and axially end to end. The letter "X" denotes a longitudinal or axial direction of extension of the group 100.

With reference to FIG. 5, the group 100 comprises two cigarette segments 101 with a double filter 102 interposed therebetween. The semi-finished product comprising the group 100 of segments wrapped in a connecting strip 103 defines a double cigarette.

With reference to FIG. 6, the group 100 comprises a plurality of filter segments 104 having different filtering properties. The semi-finished product comprising the group 100 of segments wrapped in a web of wrapping material 105 defines a double composite filter.

In both cases, the groups 100 are used to make up rod-shaped smoking articles; for example, cigarettes or cigarettes with composite filter.

With reference to FIGS. 1-4, the numeral 1 denotes a compacting unit for the tobacco industry, configured to axially compact the groups 100 of rod-shaped segments.

Figure 1:
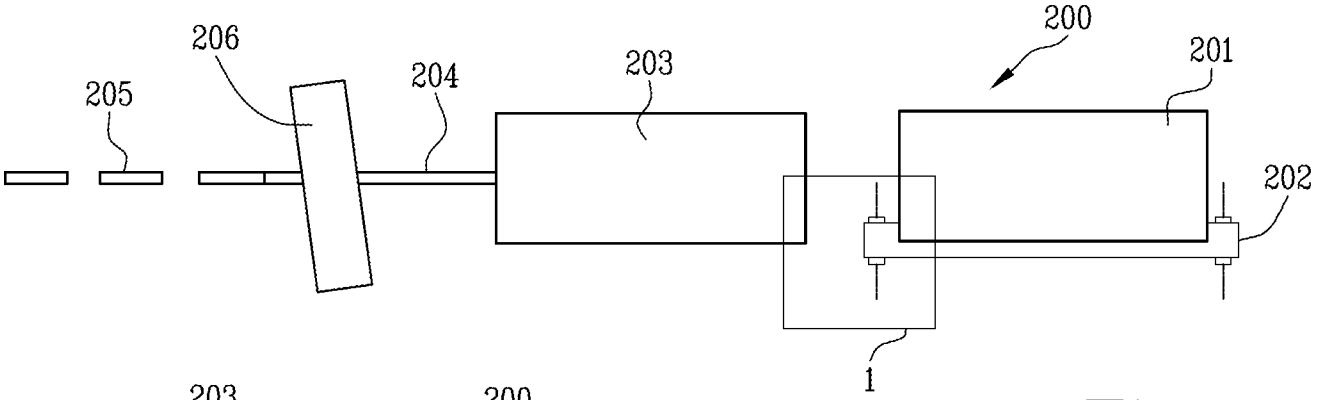
FIG. 1 is a schematic view of a first embodiment of a machine for making composite filters and to which a compacting unit and method according to this invention can be applied.
Figure 2:
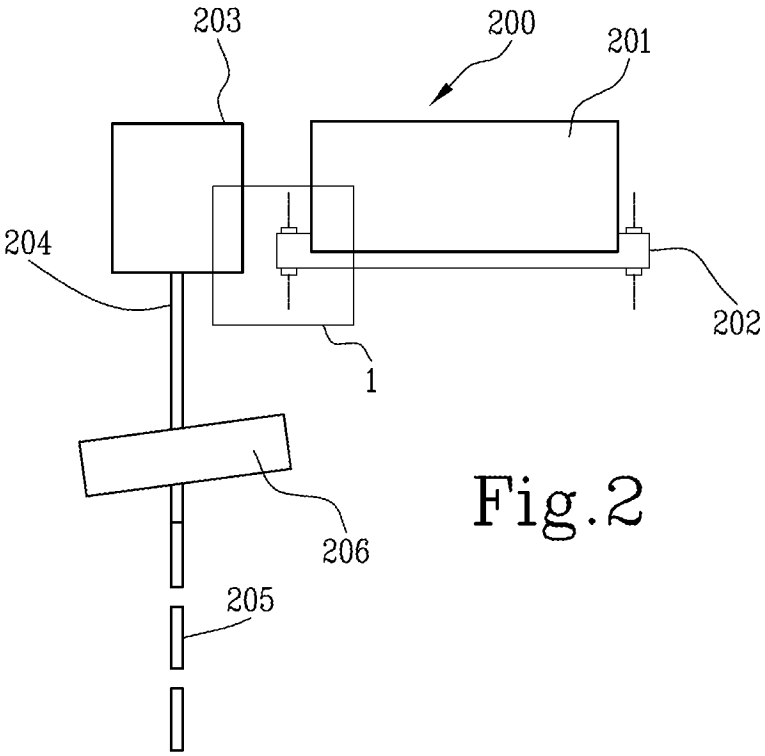
FIG. 2 is a schematic view of a second embodiment of a machine for making composite filters and to which a compacting unit and method according to this invention can be applied.

In the example illustrated in FIGS. 1 and 2, the compacting unit 1 is mounted in a machine for making composite filters 200 comprising a combining unit 201 in which individual segments from respective tanks, not illustrated, are transferred in a direction transverse to their longitudinal direction of extension to a single receiving conveyor 202 provided with peripheral grooves. The segments are placed in each peripheral groove of the conveyor according to an axial sequence to form a group 100 of segments at the exit of the conveyor. The groups are then transferred, for example by rotary transfer means, to a forming beam 203 along which they advance in a direction parallel to their longitudinal direction of extension and are wrapped in a web of wrapping material to form a continuous filter rod 204.

The continuous filter rod 204 is then cut into single or double composite filters 205 by a cutting unit 206 located downstream of the forming beam 203.

The machine 200 of FIG. 1 is an example embodiment of an inline machine, whilst the machine 200 of FIG. 2 is an example embodiment of a machine disposed at 90°.

In both cases, the compacting unit 1 may advantageously be disposed between the combining unit 201 and the forming beam 203, for example by mounting a specific conveyor or conveyor drum in the connecting stretches between these two parts of the machine. Alternatively, the compacting unit 1 might operate directly on the receiving conveyor and thus comprise it therein.

Figure 3:
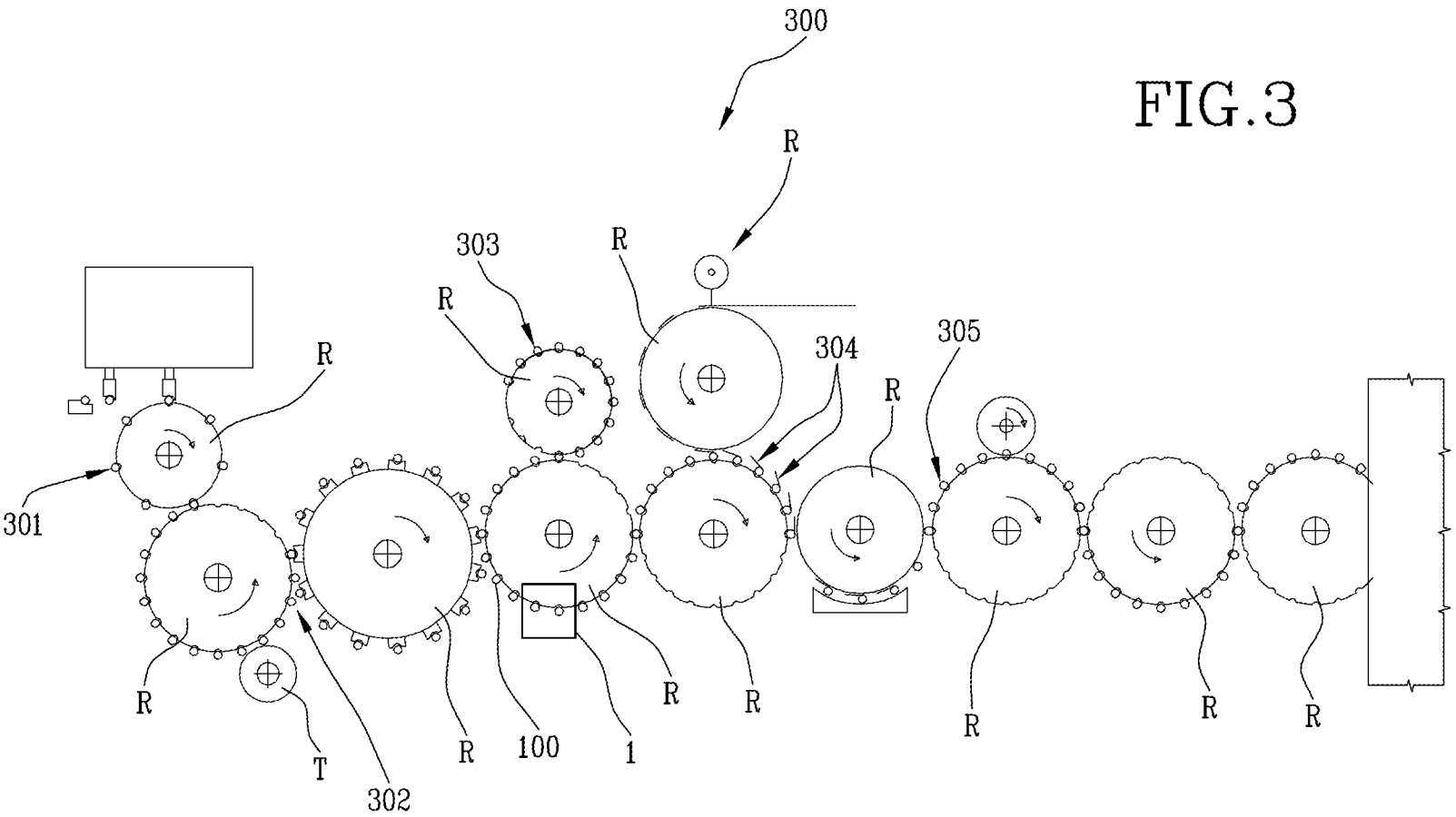
FIG. 3 is a schematic view of an embodiment of a filter tip attachment machine to which a compacting unit and method according to this invention can be applied.

In the example illustrated in FIG. 3, the compacting unit 1 is part of a machine known as filter tip attachment machine 300 and a method for making a semi-finished product defined by a double cigarette comprising cigarette segments and double filters. The filter tip attachment machine 300 is of known type and is described summarily only in the aspects of it which are relevant to this invention. More specifically, double cigarette segments 301 are transported by a sequence of rollers "R" and made to pass by a cutting device "T" which divides them transversely in half into two cigarette segments 302. The two cigarette segments 302 are spaced axially apart in such a way that a double filter 303 can be placed between them. The set of two cigarette segments with the double filter interposed therebetween defines a group of segments 100 to which a connecting strip of gummed paper 304 is then applied by rolling in order to form the semi-finished product—that is to say, the double cigarette 305. Once the double cigarettes 305 have been formed, they are made to advance in succession through a cutting station where they are cut in half transversely to obtain two rows of oppositely oriented single cigarettes.

In this case, the compacting unit 1 may be advantageously disposed upstream of the point where the connecting strip 304 is applied, by mounting a specific conveyor or conveyor drum or using a roller of the sequence of rollers "R" as conveyor drum of the compacting unit 1.

Figure 4:
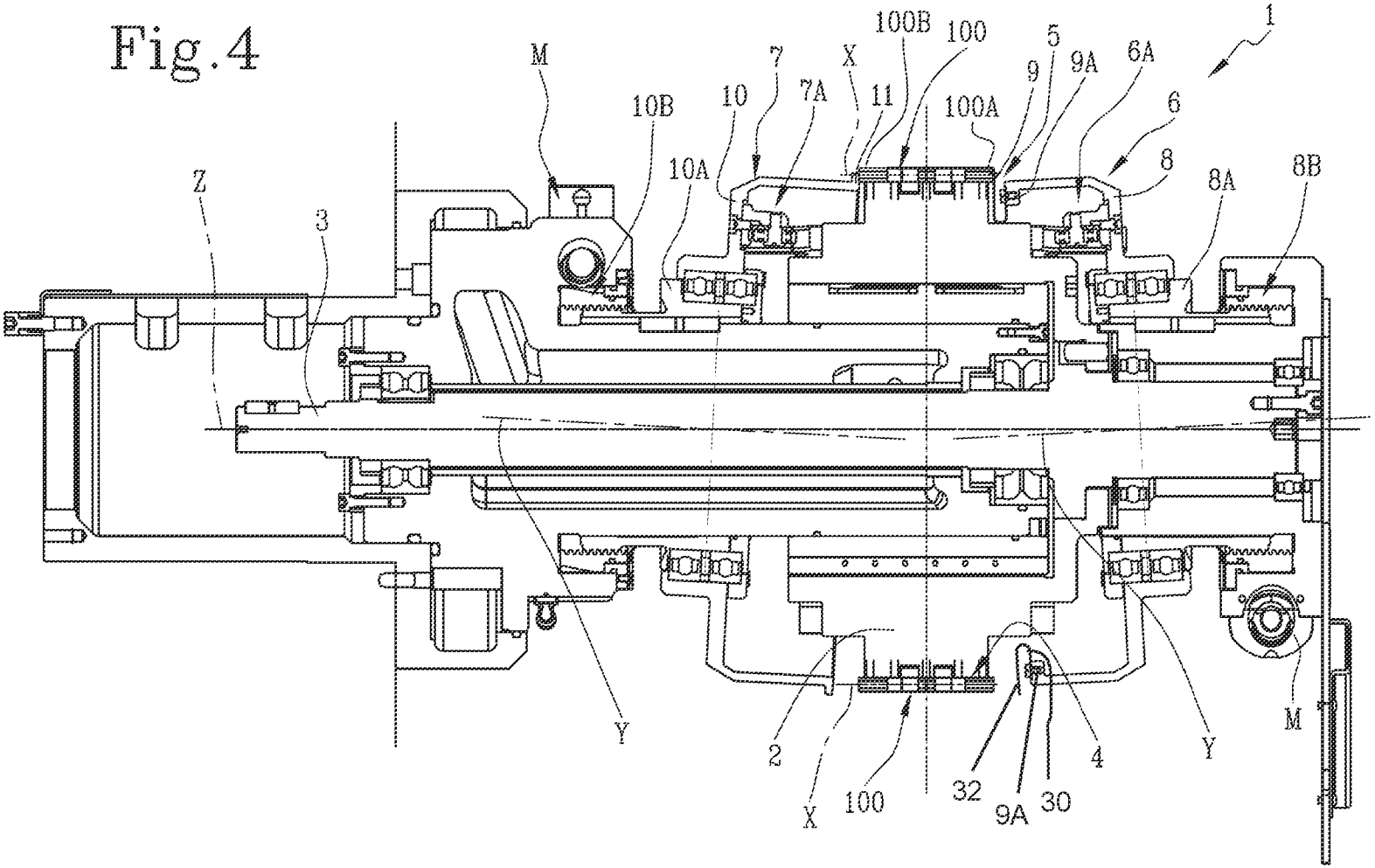
FIG. 4 schematically shows a cross-sectional view of a compacting unit according to this invention.

In a possible embodiment, illustrated for example in FIG. 4, the compacting unit 1 comprises a conveyor drum 2 defining a rotary member rotating about a feed axis "Z" of a conveyor.

Preferably, the conveyor drum 2 comprises a drive shaft 3 which extends along the feed axis "Z" and which is configured to be driven in rotation by motor means not illustrated.

The conveyor drum 2 is provided with housing grooves 4 formed in the outer mantle of the conveyor drum itself and running parallel to the feed axis "Z".

Each housing groove 4 is configured to receive and hold a group 100 of segments disposed in such a way that the longitudinal direction of extension "X" of the group 100 of segments is parallel to the feed axis "Z". Preferably, the housing grooves 4 are placed in communication with a suction system not illustrated enabling the groups 100 of segments to be held by suction.

Rotation of the conveyor drum 2 causes the housing grooves 4 to move along a feed path extending in a feed direction and the groups 100 of segments housed in the grooves 4 are transported along that feed path disposed with their respective longitudinal directions of extension "X" perpendicular to the feed direction of the groups themselves.

Along the feed path there is a compacting station 5 through which the groups 100 of segments pass. The compacting unit 1 operates at the compacting station 5 and comprises a first compactor 6 and a second compactor 7 disposed at opposite axial ends of the groups 100, at the sides of the feed path.

The first compactor 6 comprises a compacting member 8 which rotates about a compacting axis "Y" and having a first contact portion 9 disposed circumferentially around the compacting axis "Y". The first contact portion 9 is adapted to be placed in contact with a first axial end 100A of at least one group of segments 100 in transit in the compacting station 5.

The first contact portion 9 is compliant, preferably elastically compliant, along the longitudinal direction of extension "X" of the groups of segments 100 upon interaction with the first axial end 100A of the groups.

Preferably, the first contact portion 9 is defined by a leaf spring mounted on the compacting member by connector/connecting means—for example, threaded elements 9A— in such a way as to have a first arm 30 mounted on the compacting member 8 of the first compactor 6 and a second arm 32 which oscillates relative to the first arm as a result of interaction with the first axial end 100A of the first group 100 in transit in the compacting station 5.

Generally speaking, the first contact portion 9 may be inherently compliant. Alternatively or in addition, the first contact portion 9 is mounted compliantly on the compacting member 8 of the first compactor 6.

In a possible embodiment, the compacting member 8 of the first compactor 6 is driven in rotation by the conveyor drum 2, in such a way as to bring a sequence of contact surfaces of the first contact portion 9 in succession to the compacting station 5. The reference label 6A denotes drive means interposed between the compacting member 8 of the first compactor 6 and the conveyor drum 2.

Preferably, the compacting member 8 of the first compactor 6 is disposed around the feed axis "Z" of the conveyor drum 2 and the drive shaft 3, if present. Still more preferably, the compacting member 8 of the first compactor 6 has the shape of a cup with a circumferential edge, where the first contact portion 9 is circumferentially disposed.

In a possible embodiment, the compacting axis "Y" of the compacting member 8 of the first compactor 6 is inclined to the feed axis "Z" of the conveyor drum 2 so that the first contact portion 9 can be positioned in contact with the first axial end 100A of the group of segments 100 passing through the compacting station 5.

In a possible embodiment, of which the accompanying drawings constitute a non-limiting example, the position of the compacting member 8 of the first compactor 6 may be adjustable towards or away from the compacting station 5 as a function of the length of the groups of segments. For example, the first compactor 6 may comprise a slide 8A which is slidable in a direction parallel to the feed axis "Z" of the conveyor drum 2 and which supports the compacting member 8. Motor means "M" are operatively associated with the slide 8A, for example by a lead nut and screw mechanism 8B to move it towards and away from the compacting station 5.

Described below is the second compactor 7 comprising a compacting member 10 which rotates about a compacting axis "Y" and having a second contact portion 11 disposed circumferentially around the compacting axis "Y". Preferably, the compacting member 10 defines the second contact portion 11.

The second contact portion 11 is adapted to be placed in contact with a second axial end 100B of the group 100 of segments in transit in the compacting station 5.

Advantageously, the second contact portion 11 defines a rigid abutment along the longitudinal direction of extension "X" of the groups of segments 100 suitable for setting a predetermined position for the second axial end 100B of the groups of segments 100 in transit in the compacting station 5.

In a possible embodiment, the compacting member 10 of the second compactor 7 is driven in rotation by the conveyor drum 2, in such a way as to bring a sequence of contact surfaces of the second contact portion 11 in succession to the compacting station 5. The reference label 7A denotes drive means interposed between the compacting member 10 of the second compactor 7 and the conveyor drum 2.

Preferably, the compacting member 10 of the second compactor 7 is disposed around the feed axis "Z" of the conveyor drum 2 and the drive shaft 3, if present. Still more preferably, the compacting member 10 of the second compactor 7 has the shape of a cup with a circumferential edge, where the second contact portion 11 is circumferentially disposed.

In a possible embodiment, the compacting axis "Y" of the compacting member 10 of the second compactor 7 is inclined to the feed axis "Z" of the conveyor drum 2 so that the second contact portion 11 can be positioned in contact with the second axial end 100B of the group of segments 100 passing through the compacting station.

In a possible embodiment, of which the accompanying drawings constitute a non-limiting example, the position of the compacting member 10 of the second compactor 7 may be adjustable towards or away from the compacting station 5 as a function of the length of the groups of segments. For example, the second compactor 7 may comprise a slide 10A which is slidable in a direction parallel to the feed axis "Z" of the conveyor drum 2 and which supports the compacting member 10. Motor means "M" are operatively associated with the slide 10A, for example by a lead nut and screw mechanism 10B to move it towards and away from the compacting station 5.

In a possible embodiment, of which the accompanying drawings constitute a non-limiting example, the compacting unit 1 comprises two compacting members 8, 10, forming part of the first and second compactors 6, 7, respectively. Preferably, both of the compacting members 8, 10 rotate about respective compacting axes "Y" which are inclined at equal and opposite angles to the feed axis "Z" of the conveyor drum 2.

Still more preferably, the first contact portion 9 of the first compactor 6 and the second contact portion 11 of the second compactor 7 are each disposed at a minimum distance from the conveyor, preferably from the conveyor drum 2, at the compacting station 5 and at a maximum distance from the conveyor drum 2, at a position diametrically opposite to the compacting station 5.

Generally speaking, the first compactor 6 and the second compactor 7 are configured to act in conjunction with each other at least at the compacting station 5 in such a way as to apply an axial compacting action on the groups of segments 100 by means of the first and second contact portions 9, 11. At the compacting station 5, the distance between the first contact portion 9 and the second contact portion 11 is slightly less than the theoretical length of the group of segments 100 in transit in the compacting station.

In use, the compacting unit 1 allows implementing a compacting method applicable in the tobacco industry for axially compacting groups of rod-shaped segments intended to form rod-shaped smoking articles.

According to the method, the groups of segments 100 are conveyed along a feed path which extends in a feed direction and which meets a compacting station 5 for compacting the groups of segments. During transport, the groups of segments 100 are disposed perpendicularly to the feed direction.

The groups of segments 100 in transit in the compacting station 5 are subjected to an axial compacting action applied between a first contact portion 9 in contact with the first axial end 100A of the group of segments 100 and a second contact portion 11 in contact with the second axial end 1008 of the group of segments 100.

In applying this axial compacting action, the first contact portion 9 is compliant, preferably elastically compliant, along the longitudinal direction of extension "X" of the groups of segments 100 upon interaction with the first axial end 100A.

Furthermore, in applying this axial compacting action, a predetermined position of the second axial end 100B of the groups of segments 100 along the longitudinal direction of extension "X" of the groups of segments is set by the second contact portion 11, which defines a rigid abutment.

Preferably, a sequence of contact surfaces of the first contact portion 9 or of the second contact portion 11 is brought in succession to the compacting station 5.

The method also advantageously comprises adjusting the position of the first contact portion 9 and/or of the second contact portion 11 towards and away from the compacting station 5 as a function of the length of the groups of segments.

With reference to the specific example illustrated in FIG. 4, the conveyor drum 2 is set in rotation about its feed axis "Z", thereby making the groups of segments 100 move along the feed path. The rotation of the conveyor drum 2 drives the compacting members 8, 10 in rotation about the respective inclined compacting axis. Rotating the compacting members brings a sequence of contact surfaces of the first contact portion 9 or of the second contact portion 11 in succession to the compacting station 5, which is also the point of minimum distance from the conveyor drum 2 and between the two contact portions.

The compliance of the first contact portion 9 ensures that the axial compacting action is applied correctly on the groups of segments 100, whilst the rigidity of the second contact portion 11 ensures that the groups of segments 100—specifically the second axial ends 100B thereof—are correctly positioned relative to the subsequent processing stations.

In the event of changeovers, in particular regarding the length of the groups of segments 100, the compacting members 8, 10 can move translationally relative to the feed axis "Z" in order to adjust the position of the first contact portion 9 and of the second contact portion 11.

The invention as described and illustrated above can be varied in several ways.

In a possible embodiment, one or more compacting members are provided which are generically movable in such a way that a sequence of contact surfaces of the first contact portion 9 or of the second contact portion 11 is brought in succession to the compacting station.

In a possible embodiment, the conveyor may generically comprise at least one rotary member rotating about a feed axis and configured to move the housing grooves along the feed path. The rotary element previously described as a conveyor drum might be embodied in the form of a drive or return element of the conveyor, such as a pulley or return roller, for example. In this case, the compacting member of the first and/or of the second compactor may be disposed around the feed axis of that rotary element and, if necessary, with its compacting axis inclined to the feed axis of the conveyor so that the first contact portion or the second contact portion can be positioned in contact with the respective axial end of at least one group of segments passing through the compacting station.

In a further possible embodiment, the first contact portion previously described as a portion of a leaf spring might be defined by one or more of the following: a pad—for example, made of rubber or other compliant material; a plug which is movable in opposition to an elastic force; a plug which is movable in opposition to a pneumatic or hydraulic force.

The invention claimed is:

1. A compacting unit for tobacco products, configured to axially compact groups of rod-shaped segments intended to form rod-shaped smoking articles, wherein each group of segments comprises at least two segments which are disposed in axial alignment with each other and axially end to end, the compacting unit comprising:

a conveyor drum configured to convey the groups of segments along a feed path which extends in a feed direction and which meets a compacting station for compacting the groups of segments, wherein the conveyor drum includes a plurality of housing grooves, each housing groove being configured to receive and retain one of the group of segments disposed perpendicularly to the feed direction, a first compactor having a first contact portion adapted to be placed in contact with a first axial end of at least one of the group of segments in transit in the compacting station, a second compactor having a second contact portion adapted to be placed in contact with a second axial end of the at least one of the group of segments in transit in the compacting station, wherein the conveyor drum rotates about a feed axis and includes the housing grooves arranged parallel to the feed axis at an outer mantle of the conveyor drum to move the housing grooves along the feed path, wherein the first compactor and the second compactor are configured to act in conjunction with each other at least at the compacting station to apply an axial compacting action on the at least one of the group of segments via the first contact portion and second contact portion, wherein the first compactor comprises a first compacting member rotatable about a first compacting axis, wherein the first contact portion is disposed circumferentially around the first compacting axis and is mounted on the first compacting member to protrude axially from the first compacting member towards the second compacting member, the first contact portion having a first end mounted on the first compacting member and a second end, opposite the first end, being a free end and configured to engage by contact the first axial end of the at least one of the group of segments in transit in the compacting station, wherein the first contact portion is configured to be elastic and/or be mounted elastically on the first compacting member such that the second end is resiliently mounted on the first compacting member by an elastic portion and is axially movable towards and away from the first compacting member, wherein, upon axial engagement between the second end and the first axial end of the at least one of the group of segments in transit in the compacting station, the elastic portion becomes elastically deformed and the second end is subject to a spring force, exerted by the elastic deformation of the elastic portion, directed away from the first compacting member and towards the first axial end of the at least one of the group of segments in transit in the compacting station, to compact the at least one of the group of segments, wherein the second compactor comprises a second compacting member defining the second contact portion, wherein the first compacting member is disposed around the feed axis and the first compacting axis is inclined to the feed axis such that the first contact portion is placed in contact with first axial end passing through the compacting station and such that the first contact portion is disposed at a minimum distance from the conveyor drum at the compacting station and at a maximum distance from the conveyor drum at a position diametrically opposite to the compacting station.

2. The compacting unit according to claim 1, wherein at least one chosen between the first contact portion and the second contact portion includes a sequence of contact surfaces and is movable to bring the sequence of contact surfaces in succession to the compacting station.

3. The compacting unit according to claim 2, wherein the compacting member of the second compactor is rotatable about a second compacting axis and the second contact portion is disposed circumferentially around the second compacting axis.

4. The compacting unit according to claim 3, wherein the second compacting member is disposed around the feed axis and the second compacting axis is inclined to the feed axis such that the second contact portion is placed in contact with the second axial end passing through the compacting station.

5. The compacting unit according to claim 4, wherein the second contact portion is disposed at a minimum distance from the conveyor drum at the compacting station and at a maximum distance from the conveyor drum at a position diametrically opposite to the compacting station.

6. The compacting unit according to claim 2, wherein a position of at least one chosen from the first and second compacting members is adjustable towards or away from the compacting station as a function of a length of the group of segments.

7. The compacting unit according to claim 6, wherein at least one chosen from the first compactor and the second compactor comprises a slide which is slidable in a direction parallel to the feed axis and which supports the respective compacting member.

8. The compacting unit according to claim 2, wherein the at least one chosen between the first contact portion and the second contact portion is moved by the conveyor drum to bring the sequence of contact surfaces in succession to the compacting station.

9. The compacting unit according to claim 1, wherein the first contact portion includes a leaf spring mounted on the first compacting member with a connector.

10. The compacting unit according to claim 9, wherein the leaf spring has a first arm mounted on the first compacting member and a second arm which oscillates relative to the first arm as a result of interaction with the first axial end in transit through the compacting station.

11. The compacting unit according to claim 1, wherein, before axial engagement between the second end of the first contact portion and the end of the at least one of the group of segments in transit in the compacting station, the elastic portion is undeformed.

12. The compacting unit according to claim 1, wherein an entirety of the first compactor is rotatable around the feed axis.

* * * * *